United States Patent [19]

Spencer

[11] Patent Number: 4,756,646

[45] Date of Patent: Jul. 12, 1988

[54] DEEP HOLD SETTLING CHAMBER

[76] Inventor: Gilbert Spencer, 1330 E. Lake Dr., Ft. Lauderdale, Fla. 33301

[21] Appl. No.: 870,368

[22] Filed: Jun. 4, 1986

[51] Int. Cl.[4] ..... B65G 53/40

[52] U.S. Cl. ..... 406/122; 406/39; 414/291; 414/143

[58] Field of Search ..... 406/38, 39, 124–126, 406/104; 414/291, 140, 143, 144

[56] References Cited

U.S. PATENT DOCUMENTS

| | | | |
|---|---|---|---|
| 323,226 | 7/1885 | Smith . | |
| 602,888 | 4/1898 | Walsh . | |
| 926,122 | 6/1909 | Johnson . | |
| 1,427,091 | 8/1922 | Case . | |
| 1,521,404 | 12/1924 | Smith . | |
| 1,808,862 | 6/1931 | Peterson . | |
| 1,869,970 | 8/1932 | Kind . | |
| 2,255,448 | 9/1941 | Morris | 414/291 |
| 2,505,982 | 5/1950 | Meissner | 214/15 |
| 2,557,016 | 6/1951 | Smith | 214/15 |
| 2,799,403 | 7/1957 | Friedman | 212/83 |
| 2,893,574 | 7/1959 | Bartenfeld | 214/15 |
| 3,077,270 | 2/1963 | Vander Laan et al. | 214/15 |
| 3,191,998 | 6/1965 | Howlett | 302/52 |
| 3,217,904 | 11/1965 | Knight, Jr. | 414/140 |
| 3,374,910 | 3/1968 | Hermanns | 406/109 |
| 3,384,248 | 5/1968 | Leitch et al. | 214/2 |
| 3,458,028 | 7/1969 | Tidemand-Johannessen | 198/213 |
| 3,739,893 | 6/1973 | Kaufmann | 193/17 |
| 3,794,388 | 2/1974 | Westenberg | 302/58 |
| 3,867,969 | 2/1975 | Garnett | 141/59 |
| 3,876,059 | 4/1975 | Durst | 198/77 |
| 3,917,354 | 11/1975 | Adams, Jr. | 406/39 |
| 4,098,412 | 7/1978 | Shakshober | 214/15 |
| 4,152,029 | 5/1979 | Cowpertwait | 406/38 |
| 4,525,107 | 6/1985 | Feldsted | 406/109 |
| 4,568,232 | 2/1986 | Juelich et al. | 414/143 |

*Primary Examiner*—Joseph F. Peters, Jr.
*Assistant Examiner*—L. M. Fiorito
*Attorney, Agent, or Firm*—Steele, Gould & Fried

[57] ABSTRACT

A method for cleanly unloading dry bulk material carried by ships in below-deck holds is disclosed. The method includes the steps of disposing a portable open-topped, intermediate collection station in at least one empty hold of a ship. Loads of material in at least one filled hold are moved in at least one receptacle to the open-topped, intermediate collection station in the at least one empty hold. Airborne dust is continuously collected from over the intermediate collection station to prevent local formation of a dust cloud. The material is transferred from the intermediate collection station through closed conduit structure to an on-shore collection station. Exposure of the drying material to conditions likely to cause dust clouds and likely to result in wetting of the material is minimized. Apparatus for use in cleanly unloading dry bulk material from the holds of a ship includes an open-topped hopper adapted to be lifted into and out of an operative position in the at least one empty hold. Suction apparatus disposed about the periphery of the top of the hopper draws material out of the air above the hopper to prevent formation of a dust cloud. Structure at the outlet of the hopper pumps the material from the hopper through a closed conduit to an on-shore collection station.

11 Claims, 4 Drawing Sheets

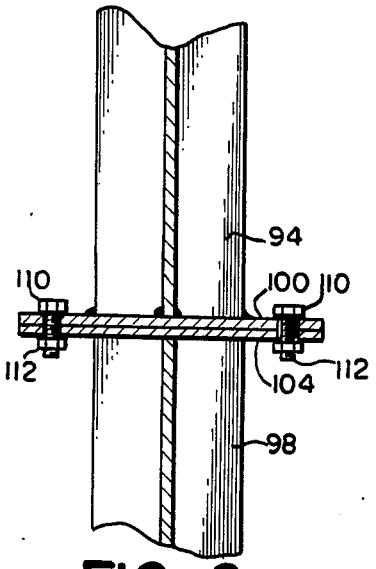
FIG. 8
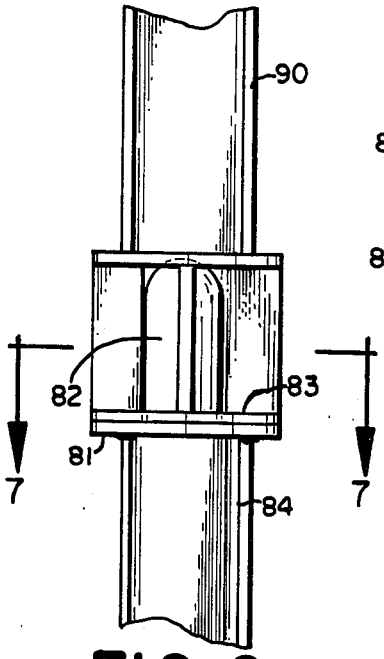
FIG. 6
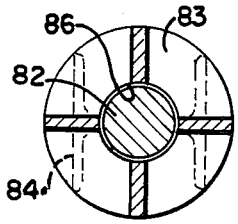
FIG. 7
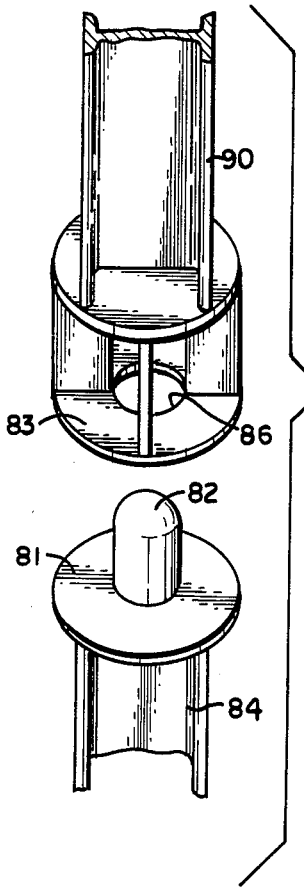
FIG. 5
FIG. 4
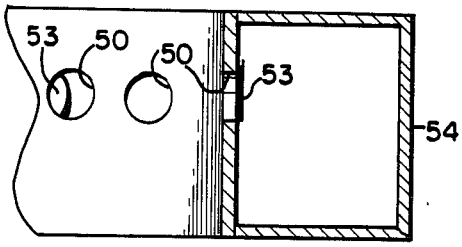

DEEP HOLD SETTLING CHAMBER

BACKGROUND OF THE INVENTION

1. Field of the Invention

This invention relates generally to materials handling, and more particularly to unloading dry bulk materials from the holds of ships.

2. Description of the Prior Art

Increasing concern over the environment has spurred numerous laws regulating the manner and extent to which industrial processes may affect the environment. Particularly with regard to materials handling apparatus and processes, this has meant tighter restrictions on the amount of material which can be released into the atmosphere. Efficiently meeting, and better still exceeding, these standards has been especially difficult in the maritime setting where dry bulk materials must be unloaded from the holds of ships. Processes and apparatus which might work well on shore are often too expensive or unworkable in the maritime setting.

The transitory nature of the cargo ships at the dock makes it difficult to use bulk transfer processes and apparatus which are successful on land. In some cases it would be necessary to modify each and every ship to accomodate a particular new process. In other cases it might be necessary to modify the process to accomodate different ship designs. The huge amounts of material which are moved can also be a significant impediment. It is not uncommon for each hold of a ship handling cement, for example, to carry eleven thousand tons of the material. Many processes which might otherwise be suitable are not capable of handling large quantities of materials such as this.

Bulk materials handling in the maritime setting is almost always an open-air process. Each ship hold is unloaded through an opened main hatch in the deck of the ship. Conveyors, conduits and the like necessary for continuous unloading processes are set down into, and extend out from, the hold through the opened main hatch. In the event of a rainstorm, sudden winds or the like, the hatch cannot be easily closed. If the bulk material can be damaged by water, as with cement, extensive damage can result.

Materials handling is an old and varied art. Hoppers, conveyors, buckets, conduits and the like, of many shapes and sizes, have been used to move bulk materials from one place to another. This equipment, however, often does not meet often newer and stricter environmental standards when used in conventional processes. It would desirable to provide a process and apparatus which would move bulk materials from the holds of ships to on-shore collection stations in a manner which meets or even exceeds environmental standards. It would also be desirable if the system would operate on many ship designs and with no modification necessary to existing ships. The crews on ships are typically responsible for unloading. It would therefore be desirable if the process of unloading did not require the extensive development of new skills such that crews uneducated in the workings of the process and apparatus would have difficulty in unloading the cargo.

SUMMARY OF THE INVENTION

It is an object of the present invention to provide a process and apparatus for transporting bulk material from the holds of ships in a manner which meets or exceeds environmental standards.

It is another object of the invention to provide a bulk transfer process and apparatus which may operate on many ship designs and with little or no necessary modification to the ship.

It is yet another object of the invention to provide a bulk transfer process and apparatus for unloading ships which can be readily learned by crews uneducated in the workings of the process.

It is still another object of the invention to provide a bulk transfer process and apparatus for unloading ships which allows the main hatch of the ship to be rapidly closed in the event of a rainstorm or other sudden adverse conditions.

These and other objects are accomplished by a method and apparatus for cleanly unloading dry bulk material carried by ships in below deck holds. A plurality of the holds are filled with the material and at least one of the holds is empty. A portable open-topped, intermediate collection station is disposed in the at least one empty hold. Loads of the material are moved in at least one closed receptacle from the filled holds to the open-topped, intermediate collection station in the at least one empty hold. Airborne dust is continuously collected at a dust collecting station from over the collection station to prevent local formation of a dust cloud. The dry bulk material is then transferred from the intermediate collection station through closed conduit means to an on-shore collection station. Exposure of the dry material to conditions likely to cause dust clouds and likely to result in wetting of the material is thereby minimized.

The dry bulk material is preferably transferred from the intermediate collection station to the on-shore collection station along a path passing through an opening in the deck of the ship, such that the at least one empty hold can be covered without interrupting the transferring step.

The intermediate collection station is preferably provided as an open-topped hopper. Pneumatic means are provided for collecting the airborne dust at the dust collecting station. The pneumatic means preferably comprises suction ports disposed about the periphery of the top of the hopper. Vacuum applied to the suction ports draws the airborne dust into a collection conduit disposed about the periphery of the top of the portable collection station.

Means are provided for pumping the material out of the hopper. Preferably, the dry bulk material is pneumatically pumped from the intermediate collection station to the on-shore collection station.

The dry bulk material is moved from the filled holds to the portable collection station in at least one clam shell bucket. The clam shell bucket is substantially closed during movement and preferably has a closed top cover portion to prevent releasing airborne dust during movement. The clam shell bucket is preferably operated by a ship-mounted crane.

The airborne dust drawn through the suction ports is preferably filtered on board ship. This can be accomplished by suitable means including the traditional bag house filter design. The filter bags are preferably mechanically or pneumatically shaken periodically to release the collected dust.

The open-topped hopper can be conveniently mounted in a portable framework adapted to be lifted into and out of the operative position in the at least one empty hold. The framework may be provided as a monolithic structure, or may be provided as plural structures which may be detachably interconnected by suitable means such as dowels.

The dust collecting station is operatively connected to the suction means but can be located remotely therefrom. The dust collecting station is also locatable remotely from the framework.

BRIEF DESCRIPTION OF THE DRAWINGS

There are shown in the drawings forms and embodiments which are presently preferred it being understood, however, that the invention is not limited to the precise arrangements and instrumentalities shown, wherein:

FIG. 4 is a cross section through a hopper of the invention as indicated by the line 4—4 in FIG. 3.

FIG. 5 is an exploded perspective of framework connecting structure according to the invention.

FIG. 6 is a side elevation of framework connecting structure according to the invention.

FIG. 7 is a cross section of the framework connecting structure of FIG. 6 according to the line 7—7 in FIG. 6.

FIG. 8 is a cross section of alternative framework connecting structure.

DETAILED DESCRIPTION OF THE PREFERRED EMBODIMENTS

Apparatus

Cargo ships used to carry dry bulk materials typically have a plurality of holds. These holds may nevertheless be quite large. A ship carrying cement, for example, may carry eleven thousand tons or more in a single hold. A ship's carrying capacity usually requires that at least one hold be left empty due to the weight of heavy bulk materials. Cargo ships also typically have a mobile crane which typically unloads cargo from the holds of the ship to on-shore receptacles or conveyors. The present invention takes advantage of these facts while providing an environmentally sound method and apparatus for unloading dry bulk materials from ships.

Figure 1:
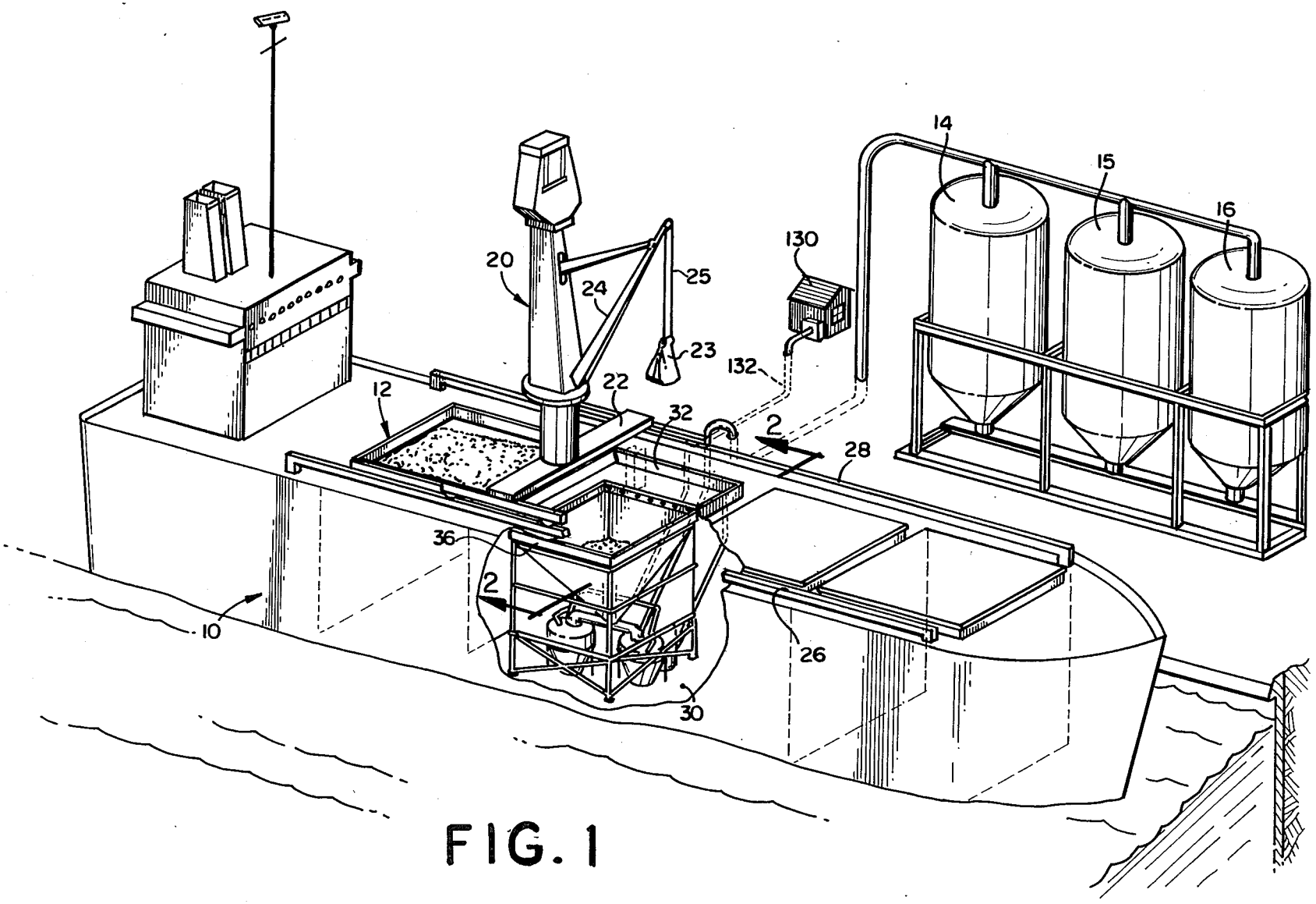
FIG. 1 is a perspective, partially broken away, of a ship being unloaded according to the invention.

Referring now to FIG. 1, a cargo ship 10 has a plurality of cargo holds including a hold 12 filled with cement which is to be unloaded and transported to on-shore collection stations such as silos 14–16. The ship will usually be outfitted with a crane 20 which is commonly mounted on a base 22 so as to be pivotable about its vertical axis. The ship's crane 20 typically has a clam shell bucket 23 suspended from a boom 24 by an operating cable 25. The ship's crane 20 is typically made movable relative to the plurality of holds by suitable structure including rails 26, 28 along which the base 22 of the crane may be moved by a suitable driving motor. The ship's crane 20 may thereby be positioned properly for the hold which is being unloaded.

Figure 2:
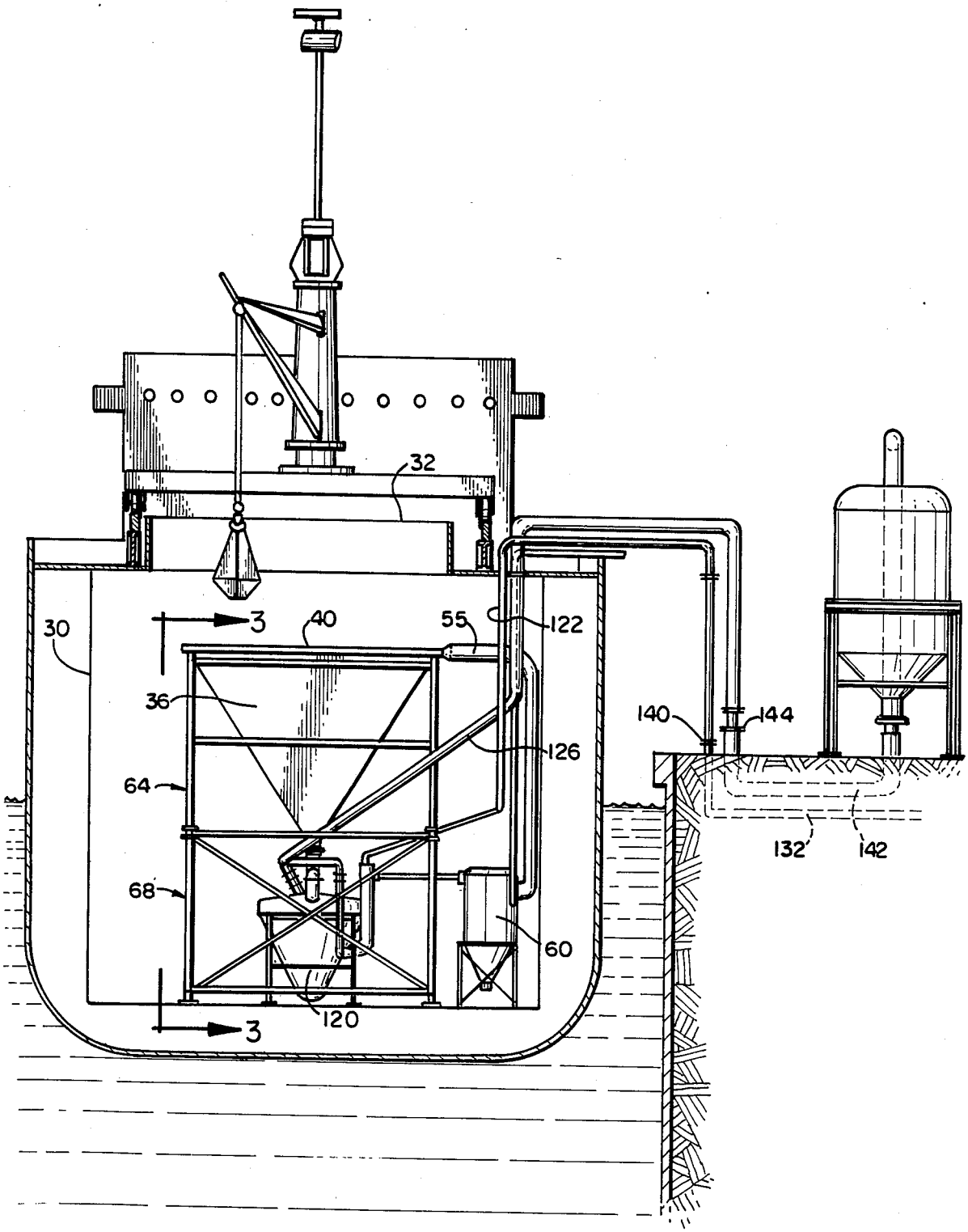
FIG. 2 is a cross section through the beam of the ship according to the line 2—2 in FIG. 1.
Figure 3:
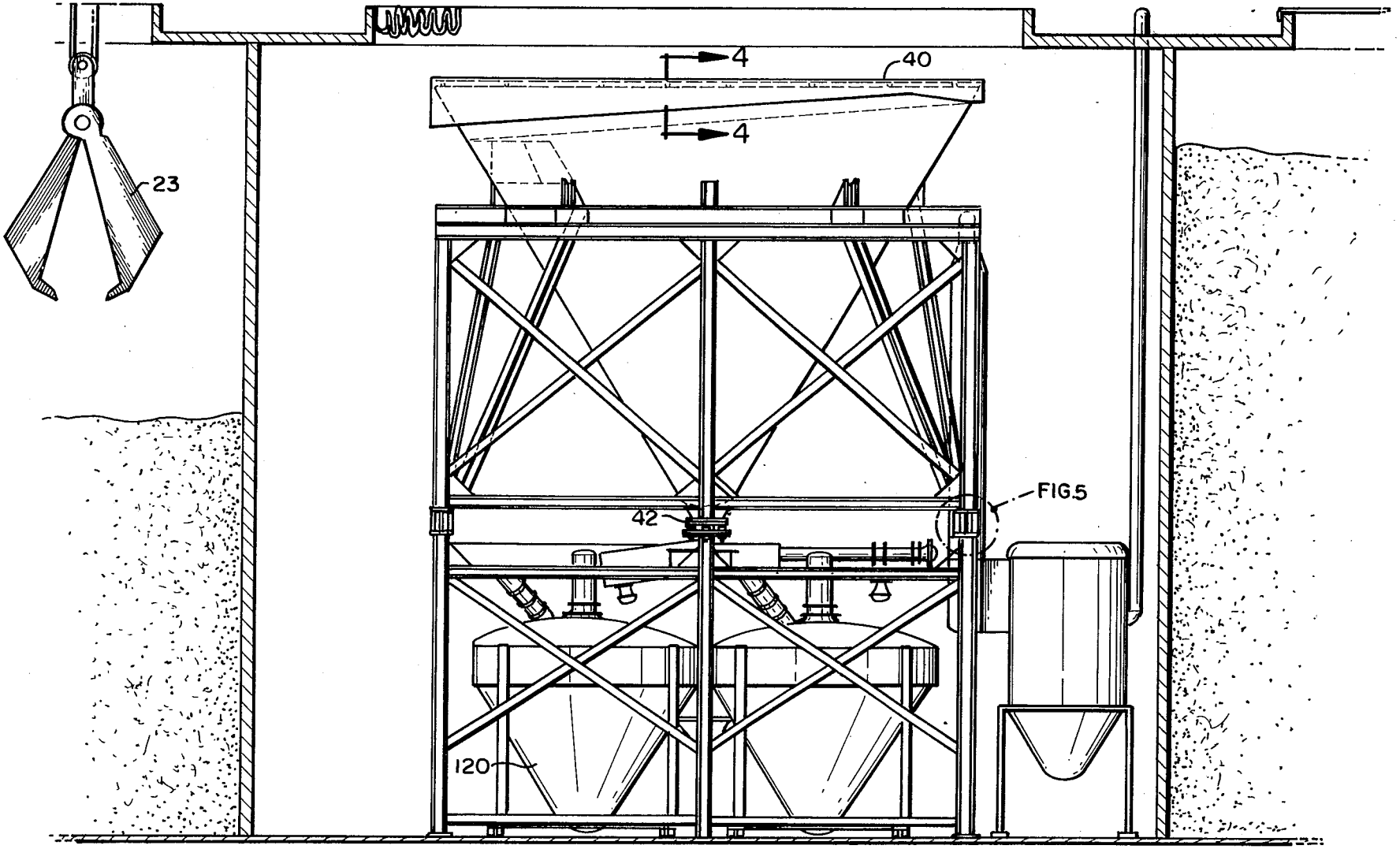
FIG. 3 is a cross section through the length of the ship according to the line 3—3 in FIG. 2.

A hold 30 with a main hatch opening 32 is empty as required by the carrying capacity of the ship. A hopper 36 is provided in the empty hold 30. The hopper 36 serves to collect the dry bulk material and preferably is cyclone-shaped with a substantially V-shaped cross section (FIGS. 2–3). A large diameter inlet 40 is provided at the top of the hopper and a small diameter outlet 42 smaller in diameter than the large diameter inlet 40 is provided at the bottom of the hopper. The upwardly increasing cross-sectional area of the hopper slows the upward flow of air and dust when dry bulk materials are dropped into it and thereby helps to prevent the formation and escape of dust clouds. A lump grate can be positioned in the hopper to screen out large solid chunks of material which might otherwise clog the system.

The hopper need not be of any particular set of dimensions. It is advisable for efficient unloading that the hopper have a capacity to hold such a quantity of materials that material may be continuously fed to the transfer apparatus notwithstanding the discontinuous transfer of material to the hopper by the ship's crane 20. An eighty ton capacity is desirable, for example, where cement is unloaded, and accordingly may have an inlet with an inside diameter of 24' or more. A cone shaped hopper has been found to be particularly useful. The cone angle should provide sufficient divergence to slow the upward flow of air and dust. The cone should not be so flat, however, as to retard the downward flow of cement. It has been found that the included cone angle (from side to side) preferably should not exceed 65 degrees from the cone axis, and would preferably not be less than 55 degrees. The large diameter inlet 40 of the hopper should be wide enough to allow the clam shell bucket 23 to open within the hopper. The bucket then acts as a lid over the hopper to reduce dust cloud formation when material is dropped into the hopper.

The hopper 36 preferably has associated with its inlet 40 structure for applying a vacuum to the area of the inlet 40 and above and below it. Suitable vacuum structure would preferably include a plurality of openings 50 around the inside rim of the inlet 40 of the hopper (FIG. 4). The dimensions of the openings 50 are preferably adjustable to permit adjustment of the flow rates therethrough. This can be accomplished by the provision closure means which can include plates 53 slidably or pivotably mounted at the openings 50. The closure means will preferably permit at least a 3:1 adjustment in the area of each opening 50, as from a one and one-half inch effective diameter to a one-half inch effective diameter. The openings 50 connect to manifold 54 through which the vacuum is applied. The manifold 54 is connected, as by vacuum conduit 55, to a vacuum source 60 which supplies a suitable vacuum to the inlet 40 of the hopper 36. The manifold 54 is preferably constructed so that it has a greater cross-sectional area adjacent the vacuum conduit 55 to accommodate the greater volumetric flow rates that are present in this portion of the manifold owing to the many upstream openings 55. This allows the velocity of the air stream through the manifold 54 to be kept substantially the same despite the large differences in volumetric flow rates in different parts of the manifold 54. Excessive velocity will cause unnecessary energy losses, and insufficient velocity will allow the dust to settle.

The vacuum source 60 preferably includes a filtration unit to remove the particulate matter from the airstream, although the filtration unit may, of course, be provided separately from the vacuum source. A suitable filtration unit may be selected from numerous units available for this purpose. A preferable filtration unit would be of the "bag house" design. The bag house, as is known in the art, has a plurality of filter bags through which the air stream is drawn and where the particulate contaminants are caught by the filter material. The bag house used in the present example might have one hundred forty-four filter bags. Each bag is generally tubular in shape and may have a diameter of approximately ½ foot and a length of approximately 12 feet. The vacuum source 60 draws air through the openings 50 at the inlet 40 of the hopper, through the vacuum 55 conduit, and then through the bag house so that particulate matter is filtered through the filter bags.

The vacuum source 60 is sized for the size of the hopper 36, its inlet 40, as well as for the particular material being handled and its flow rate. The vacuum source for the 24' diameter hopper described above would draw approximately twenty thousand cubic feet per minute of air through the manifold 54 and the bag house. This would preferably correspond to a capture velocity of approximately 50–100 ft/min at the openings 50, a velocity range in which good dust capture has been obtained. It is desirable to keep the air velocity through the manifold 54 and vacuum conduit 55 to the filtration unit around or above 4000 ft/min to keep the cement dust from settling. Velocities much above about 6000 ft/min result in large energy losses. Velocities would preferably be between about 3000 ft/min and about 7000 ft/min.

Filtration eventually causes the filter bags to become clogged with the filtered particulate matter and it may be necessary to periodically clear the bags to regain efficient filtration. This may be accomplished by several methods, including air pulses and mechanical shaking. If pulses of air are used, an airstream of perhaps 100 psig would be blown onto the filter bags in a direction opposite to that of the flow of the filtered stream. The particulate matter is blown from the filter material and falls to a collector beneath the bag house. The collector is periodically emptied. The collector may be emptied manually, or structure may be provided to remove the collected particulate matter.

A framework is preferably used to support the hopper and may be constructed in a variety of designs and from a variety of materials. An adequate framework must support the hopper and the substantial weight of material which can be in the hopper, sometimes weighing more than eighty tons. The framework should be dimensioned such that the top of the hopper 36 is not near the main hatch 32 of the hold 30. This will prevent released dust from escaping from the hold, and allow the hold to act essentially as a settling chamber for the dust. The framework can be provided as a single, integral unit. Alternatively, the framework may be provided in pieces which are fastened together in the hold of the ship. It should be recalled that the hopper may be dimensioned to hold more than eighty tons of cement and that this large scale structure must be lifted into the hold by the ship's crane. It is desirable to break-up the structure into readily assembled, lighter weight portions which are more easily installed. The framework shown in the drawing has two halves consisting of an upper half 64 and a lower half 68. The lower half 68 would be placed in the hold first, resting on the floor of the hold. The upper half 64 preferably has the hopper 36 fastened thereto. The upper half would be placed over the lower half and the two would be fastened together by suitable fastening structure. In this way the framework and hopper are more easily moved into and out of the hold to provide a more portable system.

Framework pieces can be fastened together by means known in the art for this purpose. One suitable structure is the dowel-aperture arrangement shown in FIGS. 5–7. Abutting flange portions 81 and 83 on framework pieces 84 and 90, respectively, provide a secure contact surface for the joint. Dowel portion 82 on flange portion 81 snugly mates with aperture portion 86 on flange portion 83 to secure the joint together. The weight of the materials in the hopper 36 vertically secures the abutting ends of the upper framework half 64 to the lower framework half 68.

Several framework pieces can be difficult to secure together by two-directional fastening structure such as dowels. It is therefore within the scope of the invention to secure framework pieces together by three-directional fastening structure as shown in FIG. 8. Framework pieces 94 and 98 with abutting flange portions 100 and 104, respectively, are secured together by suitable fastening means such as bolts 110 and nuts 112.

Pump means 120 is provided to move the bulk material out of the hopper. The pump means may be selected from a variety of pumps known for this purpose. The pump should be capable of moving very large amounts of dry bulk material. A preferabe pump would be capable of moving at least two hundred twenty tons per hour of a dry bulk material such as cement. Suitable pumps might include those known as "H" pumps and "M" pumps. The pump is preferably fed dry bulk material through an attachment to the small diameter outlet 42 of the hopper. This can be accomplished by a flexible plenum and a rotary air lock feeder. The pumps should be of suitable construction so as to be relatively portable, that is, able to be lifted into and out of a ship's hold. The pump would preferably have auger means driven by a motor means to move the cement or other dry bulk material to a contact zone. Alternatively, an air pump could be used in place of the auger means, as would be apparent to one skilled in the art. An airstream supplied by one or more compressors through an airstream supply conduit 122 is blown through a series of jets to the contact zone where the airstream contacts the dry bulk material. The dry bulk material is carried by the airstream through a closed outlet conduit 126 out of the hold of the ship and into on-shore storage receptacles 14–16.

A rotary air lock feeder preferably seals the inlet of the pump means 120 from the outlet 42 of the hopper. This is commonly accomplished by a plurality of vanes rotating in a closed housing which accept material at one point of rotation through an inlet opening in the housing and discharge the material into the pump at another point of rotation through a discharge opening in the housing. The point of rotation receiving material is sealed by intermediate vanes against substantial gas or material contact with the point of rotation discharging material into the pump.

Compressors supply a large volume of low pressure air or other suitable fluid to move the bulk material through the outlet conduit 126 and into the on-shore collection receptacles 14–16. The compressors preferably are capable of delivering about fifteen hundred cubic feet per minute of about 30 psig air where cement is to be transported. The compressors may be selected from a number of models and designs suitable for this purpose. The compressors may be located on-shore as in compressor station 130 (FIG. 1, compressors not shown). A permanent on-shore airstream supply conduit 132 running from the compressor storage facility 130 to dockside may be buried within the dock for convenience. The on-shore airstream supply conduit 132 would then be connected to the on-board airstream supply conduit 122 as at juncture 140 during installation. Similarly, a permanent on-shore outlet conduit 142 leading from dockside to the on-shore storage receptacles 14–16 may be buried within the dock. The on-shore outlet conduit 142 would be connected to the on-board outlet conduit 126 at dockside as at juncture 144.

Each separable component of the process and apparatus of the invention preferably weights less than fifteen tons. This allows the components to be lifted by conventional ship's cranes into the hold or onto the deck of the ship as the case may require. It would of course be possible to use larger equipment if the ship's crane can accommodate the weight.

INSTALLATION

Installation of the equipment in preparation for unloading the dry bulk material begins with placement into the hold of the airstream supply conduit 122 from the compressors and the outlet conduit 126 loading to the on-shore storage receptacles 14–16. Connections 140 and 144 to any on-shore conduit systems may be made as necessary. The airstream supply conduit 122 is directed up the side of the ship and into empty ship's hold 30. The airstream supply conduit 122 can be simply draped over the side of the main hatch into the hold. It is preferable, however, to insert the conduit through a smaller hatch of the ship leading into the hold. Most ships have at least one small manhole or the like leading into each hold in addition to the main hatch. It has been found that insertion of conduits and any other necessary lines, such as power lines, are conveniently placed into the hold through one of these smaller hatches. The main hatch may then be readily closed in the event of sudden adverse conditions such as high wind gusts or rain with minimal damage to the cement or other dry bulk material below.

The ship's crane 20 is used according to the invention to lift the necessary equipment into an empty hold. Accordingly, the crane lifts the pump means 120 into the hold 130 and sets it on the floor preferably at or near the center of the hold 130. The airstream supply conduit 122 and the outlet conduit 126 may then be connected to the pump means 120.

The framework is then preferably assembled. The framework may be constructed to set over the pump means 120 as shown in FIGS. 2–3. The hopper 36 may be attached to the framework, which supports the hopper over the pump at the proper height. A preferable method of installing the framework would provide a lower framework portion 68 and an upper framework portion 64. The hopper 36 would be secured to the upper framework portion 64. The lower framework portion 68 would be set in place over the pump, after which the upper framework portion 64, with the hopper 36, would be set in place on the lower framework portion 68. The two portions may be secured together by aligned aperture portions 86 and dowel portions 82 which snugly interfit to hold the framework together. The hopper 36 is positioned with its outlet 42 directly above the inlet to the pump, with the rotary air lock feeder positioned therebetween. The hopper is bolted to the top of the pump.

The vacuum source 60 may be set in place alongside the hopper/framework on the floor of the hold. Alternatively, the source 60 may be set on the deck of the ship. The vacuum conduit 55 is connected between the vacuum manifold 54 and the vacuum source 60. The outlet conduit 126 is preferably then hooked up to the pump means 120.

Electrical connections are made to the filtration unit and the pump means to supply the motors. The electrical equipment is preferably hooked to a starter set on the deck of the ship which supplies a power boost if necessary and provides a centralized on/off switch. The starter unit should be capable of supplying 300 amps. The electrical connections are then hooked to suitable connections on-shore.

The installation process described above can be performed in relatively short periods of time notwithstanding the size of the equipment being handled. It is desirable to have shore connections hooked up before the installation of the equipment to minimize installation time once the ship is ready for unloading.

OPERATION

In operation the ship's crane is used with a clam shell bucket 23 to lift material out of the cargo holds and place it into the hopper 36 resting in the empty hold 30. The clam shell bucket 23 should be closed topped to minimize dust formation during transport from the hold to the hopper 36. Also, the clam shell 23 should be opened within the hopper 36 to release the material into the hopper. The clam shell acts as a hood to the hopper 36 and with the hopper 36 traps and impedes dust cloud formation.

The shape of the hopper can help to slow the upward movement of dust. A hopper which is substantially conical in shape, or which has an increased cross sectional area at its top as opposed to its bottom, acts to slow the upward movement of air which would carry a dust cloud out of the hopper. Dust which nonetheless reaches the upper opening of the hopper is drawn by the vacuum created through the openings 50. This dust is carried through the vacuum conduit 55 to the filter unit, as at the vacuum source 60. In the filter unit the dust may be collected in filter bags. The filter bags may be periodically shaken or pulsed with an airstream to clear the filter bags. The removed dust particles fall into the collector where they can be manually or mechanically removed.

Some particulate matter may still escape from the large diameter inlet 40 of the hopper 36. This material is substantially prevented from reaching the atmosphere by the positioning of the hopper within the empty hold 30. The large diameter opening 40 is positioned well below the main hatch 32 of the hold 30. The large, empty hold represents a very large volume of essentially stagnant air removed from the atmospheric wind, and acts as a settling chamber for the escaped dust. Dust particles which escape from the hopper 36 encounter this stagnant air and settle to the bottom of the hold 30 where they can be collected and removed.

The dry bulk material passes through the small diameter outlet 42 of the hopper, preferably through a rotary air lock feeder, into the pump means 120. The pump moves the material by the action of an auger or by air pressure into contact with an airstream supplied by the airstream supply conduit 122. The air flows through a series of jets and contacts the material, carrying it out through the discharge conduit 126. The material travels through the discharge conduit system to the on-shore storage receptacles 14–16. Dust which has settled on the floor of the hold 30 can be swept and removed periodically.

The invention provides a means for unloading dry bulk material from ships which combines portability, speed, and environmental safety. Each of the components necessary to practice the invention can weigh under fifteen tons, and can thus be lifted into and out of the ship's hold by the ship's crane. The parts are readily assembled notwithstanding their large size. Installation is straightforward and readily accomplished by relatively few workmen. The invention takes advantage of the fact that one or more holds are commonly left empty when transporting heavy dry bulk materials. Moreover, because the components according to the invention are portable, no permanent modifications to a ship's hold are necessary to practice the invention. When the ship has been unloaded, it may immediately be loaded with another material and put directly back into service. Since all supply lines according to the invention are preferably inserted through small hatches in the deck, in the event of rain the main hatch can be closed and the material does not suffer substantial damage. The invention has been described primarily for use in unloading cement, although it would be apparent that the invention is similarly suitable for other dry bulk materials such as grain or coal. Unloading according to the invention is equal in speed according to conventional processes. Strict environmental standards are maintained according to the invention.

This invention can be embodied in other forms without departing from the spirit or essential attributes thereof, and accordingly, reference should be made to the appended claims rather than to the foregoing specification as indicating the scope thereof.

I claim:

1. A method for cleanly unloading dry bulk material, prone to forming dust clouds during movement and agitation and subject to damage from wetting, carried by ships in below-deck holds, a plurality of the holds being filled with the material and at least one of the holds being empty, comprising the steps of:

disposing a portable open-topped, intermediate collection station in the at least one empty hold;

moving loads of the material in at least one receptacle from the filled holds to the open-topped, intermediate collection station in the at least one empty hold;

continuously collecting airborne dust from over the collection station to prevent local formation of a dust cloud; and, transferring the material from the intermediate collection station through closed conduit means to an on-shore collection station, whereby exposure of the dry material to conditions likely to cause dust clouds and likely to result in wetting of the material is minimized.

2. The method of claim 1, comprising the step of transferring the material from the intermediate collection station to the on-shore collection station along a path passing through an opening in the deck of the ship, whereby the at least one empty hold can be covered without interrupting the transferring step.

3. The method of claim 1, comprising the step of providing the portable collection station with: an open-topped hopper; pneumatic means for collecting the airborne dust, including suction ports disposed about the periphery of the top of the hopper; and, means for pumping the material out of the hopper.

4. The method of claim 1, comprising the step of moving the material from the filled holds to the portable collection station in at least one clamshell bucket, the bucket being substantially closed during movement.

5. The method of claim 4, comprising the step of using a ship-mounted crane for operating the bucket.

6. The method of claim 1, comprising the step of drawing the airborne dust, by vacuum driven means, into a collection conduit disposed about the periphery of the top of the portable collection station.

7. The method of claim 1, comprising the step of pneumatically pumping the material from the intermediate collection station to the on-shore collection station.

8. An apparatus for use in cleanly unloading dry bulk material, prone to forming dust clouds during movement and agitation and subject to damage from wetting, carried by ships in below-deck holds, a plurality of the holds being filled with the material and at least one of the holds being empty, the apparatus comprising:

an open-topped hopper adapted to be lifted into and out of an operative position in the at least one empty hold, for receiving loads of the material dropped therein from a bucket means adapted to carry the material from the filled holds to the hopper in the at least one empty hold, some of the dropped material tending to become airborne over the hopper;

suction means disposed about the periphery of the top of the hopper for drawing material out of the air above the hopper to prevent formation of a dust cloud;

means connected to an outlet of the hopper for pumping the material from the hopper through a closed conduit means to an on-shore collection station; and a portable framework, the framework being adapted to be lifted into and out of the operative position in the at least one empty hold, the hopper, the suction means and the pumping means being mounted in the framework.

9. The apparatus of claim 8, further comprising a portable framework adapted to be lifted into and out of the operative position in the at least one empty hold, the hopper, the suction means and the pumping means being mounted in the framework.

10. The apparatus of claim 8, further comprising a dust collecting station operatively connected to the suction means but locatable remotely therefrom.

11. The apparatus of claim 8, further comprising a dust collecting station operatively connected to the suction means but locatable remotely from the framework.

* * * * *

UNITED STATES PATENT AND TRADEMARK OFFICE

CERTIFICATE OF CORRECTION

PATENT NO. : 4,756,646

DATED : July 12, 1988

INVENTOR(S) : Gilbert Spencer

It is certified that error appears in the above-identified patent and that said Letters Patent is hereby corrected as shown below:

Column 1, line 53 after "would" insert --be--.

Column 7, line 9 delete "weights" and insert --weighs--.

Column 7, line 20 delete "loading" and insert --leading--.

Signed and Sealed this

Fourth Day of July, 1989

*Attest:*

*Attesting Officer*

DONALD J. QUIGG

*Commissioner of Patents and Trademarks*